United States Patent [19]

Kawasaki et al.

[11] Patent Number: 4,850,803

[45] Date of Patent: Jul. 25, 1989

[54] CERAMIC RADIAL TURBINE ROTOR

[75] Inventors: Keiji Kawasaki; Kiminari Kato, both of Nagoya, Japan

[73] Assignee: NGK Insulators, Ltd., Nagoya, Japan

[21] Appl. No.: 100,449

[22] Filed: Sep. 24, 1987

[30] Foreign Application Priority Data

Oct. 1, 1986 [JP] Japan ..... 61-234157

[51] Int. Cl.[4] ..... F01D 5/28

[52] U.S. Cl. ..... 416/241 B; 415/200; 415/217.1

[58] Field of Search ..... 416/241 B; 415/118, 415/200, 212 R, 213 R, 214

[56] References Cited

U.S. PATENT DOCUMENTS 4,385,866 5/1983 Ochiai et al. ..... 416/241 B
4,692,099 9/1987 Homma et al. ..... 416/241 B
4,701,106 10/1987 Sasaki ..... 416/241 B

*Primary Examiner*—Robert E. Garrett
*Assistant Examiner*—John T. Kwon
*Attorney, Agent, or Firm*—Arnold, White & Durkee

[57] ABSTRACT

A ceramic radial turbine rotor made of a ceramic material having a strength s (kg/mm$^2$) includes blade tips having a thickness t (mm). A product st$^2$ of strength s and t$^2$ (square of t) is representative of resistance to breakage of the rotor to foreign objects colliding against blades of the rotor. The product st$^2$ fulfills a relation $st^2 \geqq 5 \times 10^4\ vm + 33$. In this case, v is a circumferential speed of tip ends of inducers of blades of the rotating rotor when the blades are damaged by steel balls having a mass m (kg) colliding against the blades in a steel ball collision test of blades of a ceramic radial turbine rotor, and vm is a product of v and m.

2 Claims, 4 Drawing Sheets

CERAMIC RADIAL TURBINE ROTOR

BACKGROUND OF THE INVENTION

This invention relates to a ceramic radial turbine rotor made of a ceramic material for use in turbochargers for automobiles and the like and gas turbine engines.

Recently, ceramic radial turbine rotors have been developed, which are made of ceramic materials such as silicon nitride ($Si_3N_4$), silicon carbide (SiC), sialon and the like in order to utilize particular properties of the ceramic materials such as light weight, heat-resistance, wear-resistance and the like.

However, the ceramic materials are brittle, and are inferior in toughness to metals an susceptible to impulsive forces. It has been progressively recognized that a turbine rotor made of a ceramic material should be different in design from a turbine rotor made of a metal in consideration of the properties of the ceramic material. For example, with a hitherto used ceramic radial turbine rotor designed without considering the brittleness of the material, inducer portions of turbine blades actually used are often damaged by foreign substances colliding against the inducer portions. Such foreign substances consist of carbon particles produced from unburned gases and metal oxide particles included in exhaust gases and produced from exhaust gas manifolds made of a metal exposed to high temperature exhaust gases.

In order to solve this problem, it has been proposed that a metal is deposited on tip ends of blades of a ceramic rotor by using a metal spray, as disclosed in Japanese Laid-open Utility Model Application No. 61-51,404.

Moreover, it has been proposed to make tip ends of blades round or provide rounded tip ends of blades to mitigate the shocks from the foreign particles as disclosed in Japanese Laid-open Patent Application No. 59-203,808.

In the former proposal of the Japanese Laid-open Utility Model Application No. 61-51,404, it is generally difficult to deposit a metal onto a ceramic material by using a metal spray. Particularly, turbine blades are used under very severe conditions such as rapid heating to high temperatures higher than 800° C., so that deposited metal films are apt to peel due to a difference in thermal expansion between the metal and the ceramic material, with the result that actual working rotors could not be obtained. Moreover, there is a tendency of the temperature at which the turbine is used to become higher every year so that metal films deposited by using a metal spray on ceramic materials are no longer used in practical applications.

In the latter proposal of the Japanese Laid-open Patent Application No. 59-203,808, the shaping the rounded tip ends of blades involves a troublesome and time-consuming operation and substantially increases the manufacturing cost of the turbine, so that the application of the proposal to industry is difficult.

SUMMARY OF THE INVENTION

The inventors of the present invention have carried out many experiments to overcome the problems in the prior art. As a result, they have clarified the behavior of foreign objects colliding against turbine blades and found that a product, $st^2$, of strength s of a ceramic material by square $t^2$ of thickness t of blade tips of a rotor, is greatly associated with the resistance to breakage of the rotor against the foreign objects. Further, the present inventors have discovered that the larger the $st^2$, the larger the resistance against the foreign objects. Stated differently, the $st^2$ is representative of the resistance force of a rotor against foreign objects. Therefore, the invention resides in the discovery that the damage of blades of a rotor caused by foreign objects can be effectively prevented by determining a thickness of blade tips depending upon a strength of a ceramic material of a ceramic radial turbine rotor.

It is a principal object of the invention to provide an improved ceramic radial turbine rotor which has a large resistance against foreign objects in operation by determining an optimum thickness of blade tips (inducer portions) depending upon used conditions (revolution per minute, temperature and like), masses of foreign objects which may enter the rotor, and a strength of a ceramic material of which the rotor is made.

In order to achieve this object, the ceramic radial turbine rotor according to the invention is made of a ceramic material having a strength s ($kg/mm^2$) and includes blade tips having a thickness t (mm) and $st^2$, representative of the resistance of the rotor to foreign objects colliding against blades of the rotor, fulfills a relation $$st^2 \geqq 5 \times 10^4 vm + 33$$

where v is a circumferential speed of tip ends of inducers of blades of the rotating rotor when the blades are damaged by steel balls having a mass m (kg) colliding against the blades in a steel ball collision test of blades of a ceramic radial turbine rotor, and vm is a product of v and m.

In carrying out the invention, the steel balls used are shots made of cast steel according to JIS (Japanese Industrial Standard) G5903. In determining the strength s of the ceramic material of the rotor, transverse breaking test pieces are made by using the same material in the same lot and the same forming method as those of the rotor blades, and the strength of the test pieces are measured as an experimental value according to the testing method of JIS R1601. As an alternative, test pieces are cut off of a hub of the rotor, which have a size one half of that prescribed in JIS R1601 and after the strength of the pieces are measured, the measured value is converted into the strength of the test piece prescribed in JIS R1601 in consideration of the volumetric efficiency. In the conversion, the following equation is used.

$$\sigma_2/\sigma_1 = (V_{E1}/V_{E2})^{1/m}$$

where $\sigma$: average strength ($kg/mm^2$)

$V_E$: effective volume ($mm^3$)

m:Weibull modulus suffix 1: value of JIS suffix 2: measured value.

The invention will be more fully understood by referring to the following detailed specification and claims taken in connection with the appended drawings.

DESCRIPTION OF THE PREFERRED EMBODIMENTS

Figure 1:
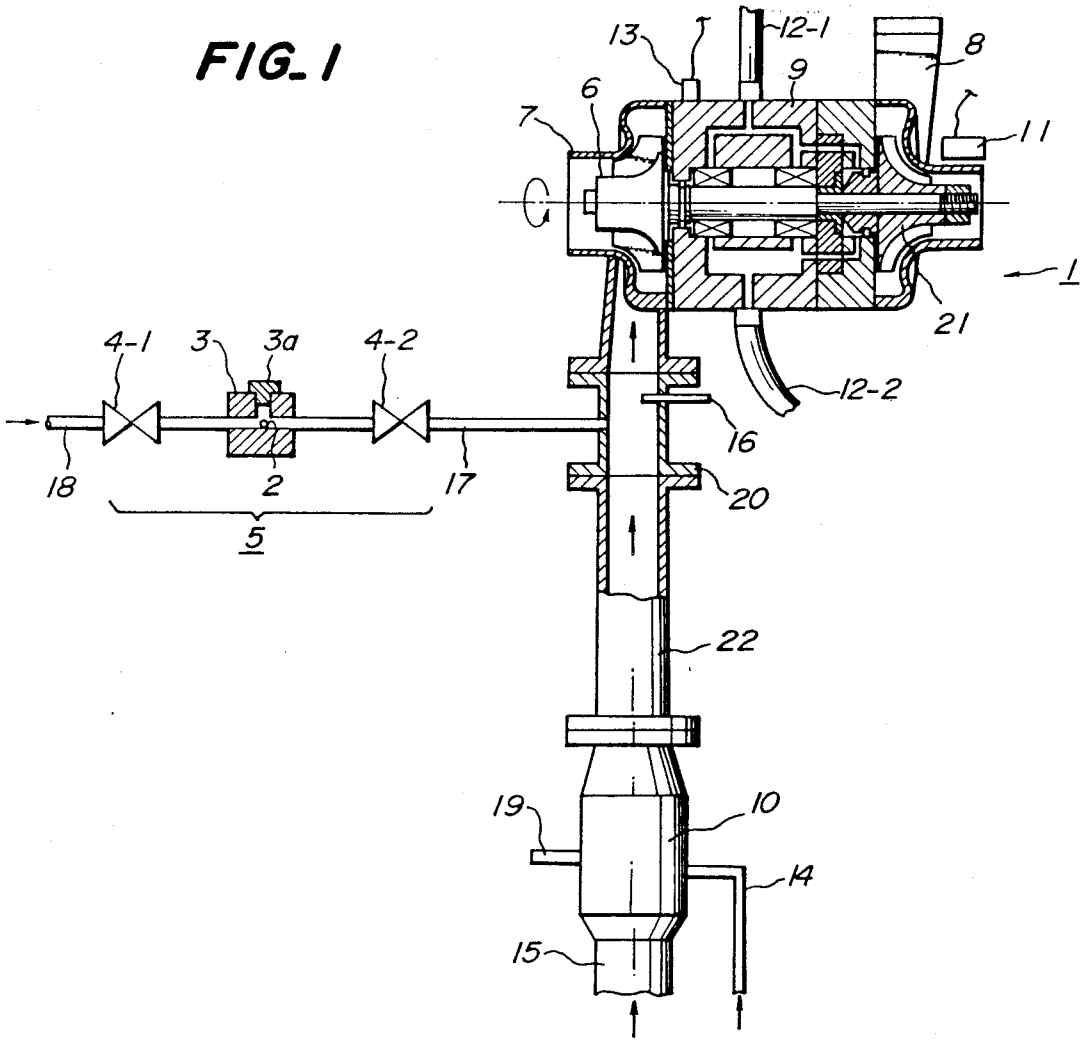
FIG. 1 is a sectional view of a steel ball collision testing machine used for carrying out the invention.

FIG. 1 illustrates in section a steel ball collision testing machine for testing the resisting faculty against foreign objects of ceramic radial turbine rotors according to the invention.

Figure 2:
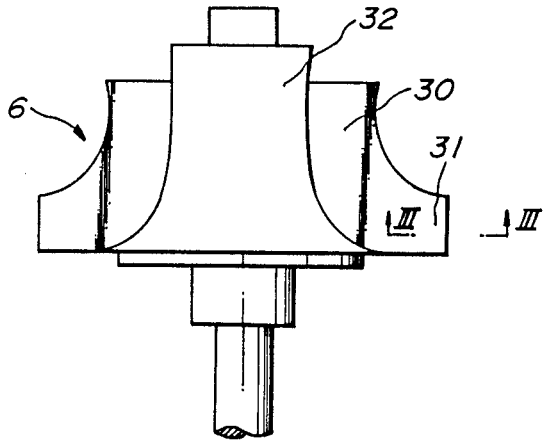
FIG. 2 is a schematic explanatory view of one example of the ceramic radial turbine rotor.
Figure 3:
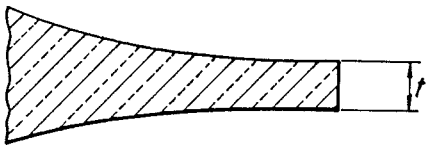
FIG. 3 is a sectional view taken along a line III—III in FIG. 2.

FIG. 2 explanatorily illustrates a ceramic radial turbine rotor. FIG. 3 is a sectional view taken along a line III—III in FIG. 2. The ceramic radial turbine comprises turbine blades 30 having inducer portions 31 having a thickness t at tip ends.

Various ceramic materials may be used for the rotor. In consideration of their strength, it is preferable to use silicon nitride ($Si_3N_4$), silicon carbide (SiC) and sialon. Among these ceramic materials, silicon nitride is the most preferable.

A foreign object resistance test of ceramic radial turbine rotors using the rest machine shown in FIG. 1 will be explained hereinafter.

Various ceramic radial turbine rotors 6 made of silicon nitride ($Si_3N_4$) and having blade outer diameters of 60 mm were prepared, which had various strengths of materials and various thicknesses of blade tips. Each of the rotors was incorporated in a bearing housing 9, and a turbocharger 1 equipped with a turbine housing 7 and a compressor housing 8 was attached to an inlet flange 20. Compressed air and a fuel were supplied into a burner 10 and ignited by an igniter 19. High temperature and high pressure gas produced from the burner 10 was fed into the turbine housing 7 to cause the ceramic radial turbine rotor 6 to rotate at a circumferential speed of tip ends of turbine blades shown in Table 1 and at a temperature of 800° C. at an inlet of the turbine.

A steel ball 2 having a mass was accommodated in a foreign object vessel 3. After the vessel 3 was closed by a cover 3*a*, a valve 4-2 was opened. A valve 4-1 was then opened, so that nitrogen gas at high pressure was supplied into the foreign object vessel 3 to feed the nitrogen gas together with the steel ball 2 into the inlet flange 20.

Under this condition, vibrations of the turbocharger 1 were measured by an acceleration vibrometer 13 and rotations of the ceramic radial turbine rotor 6 were measured by a rotation detection coil 11 to detect extraordinary rotating numbers, if any.

When no extraordinary rotation occurred, the feeding of a steel ball was repeated ten times. When ten balls had been fed, the fire of the burner 10 was put out and the ceramic radial turbine rotor 6 was cooled by the air to a room temperature. On the other hand, when an extraordinary rotation was detected, the operation of the turbine was stopped at that stage and the fire of the burner 10 was put out. The ceramic radial turbine rotor 6 was cooled by the air to the room temperature.

After cooled, the ceramic radial turbine rotor 6 was taken out of the turbine housing 7 to observe the tip ends of the inducer portions 31 of the turbine to determine whether or not damage had occurred. In case of no extraordinary vibration of the turbocharger 1, the vibration was constant 3G (where G was gravitational acceleration).

Strength of the materials, thicknesses of blade tips, circumferential speeds, masses of the steel balls and other factors and test results are shown in Table 1.

Figure 5:
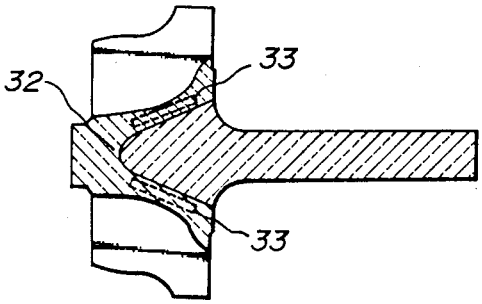
FIG. 5 is a sectional view for explaining locations where breaking test pieces are cut off of a ceramic radial turbine rotor.

In case of vibrations more than 3G, the serious damage of blades occurred as shown in Table 1. As to the strengths s of the Nos. 1, 4 and 10 of the embodiments in Table 1, test pieces 33 which were in size one half of test pieces according to JIS (Japanese Industrial Standard) R1601 were cut off hubs 32 of turbines as shown in FIG. 5. Each of these test pieces was supported by four supports with an inner span of 5 mm and an outer span of 15 mm and loaded at a crosshead speed of 0.5 mm/min for measuring four point bending strengths. Obtained strengths were converted into strengths of four point bending test pieces of JIS R1601 in consideration of the volume efficiency. As to the strengths of the remaining numbers of the embodiments in Table 1, test piece blanks were formed by the same injection molding as in the rotors, and after sintered, test pieces were cut off the blades and tested according to the test method of JIS R1601 to obtain the strengths.

Figure 4:
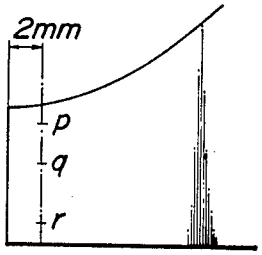
FIG. 4 is an explanatory view illustrating points of a turbine blade tip at which thickness are measured.

The thicknesses of the blade tips were measured by a point micrometer at locations of 2 mm from the blade tips as shown at three points p, q and r in FIG. 4. Minimum thicknesses were taken as the thicknesses of the blade tips.

The steel balls were shots made of cast steel prescribed in JIS G5903.

Figure 6:
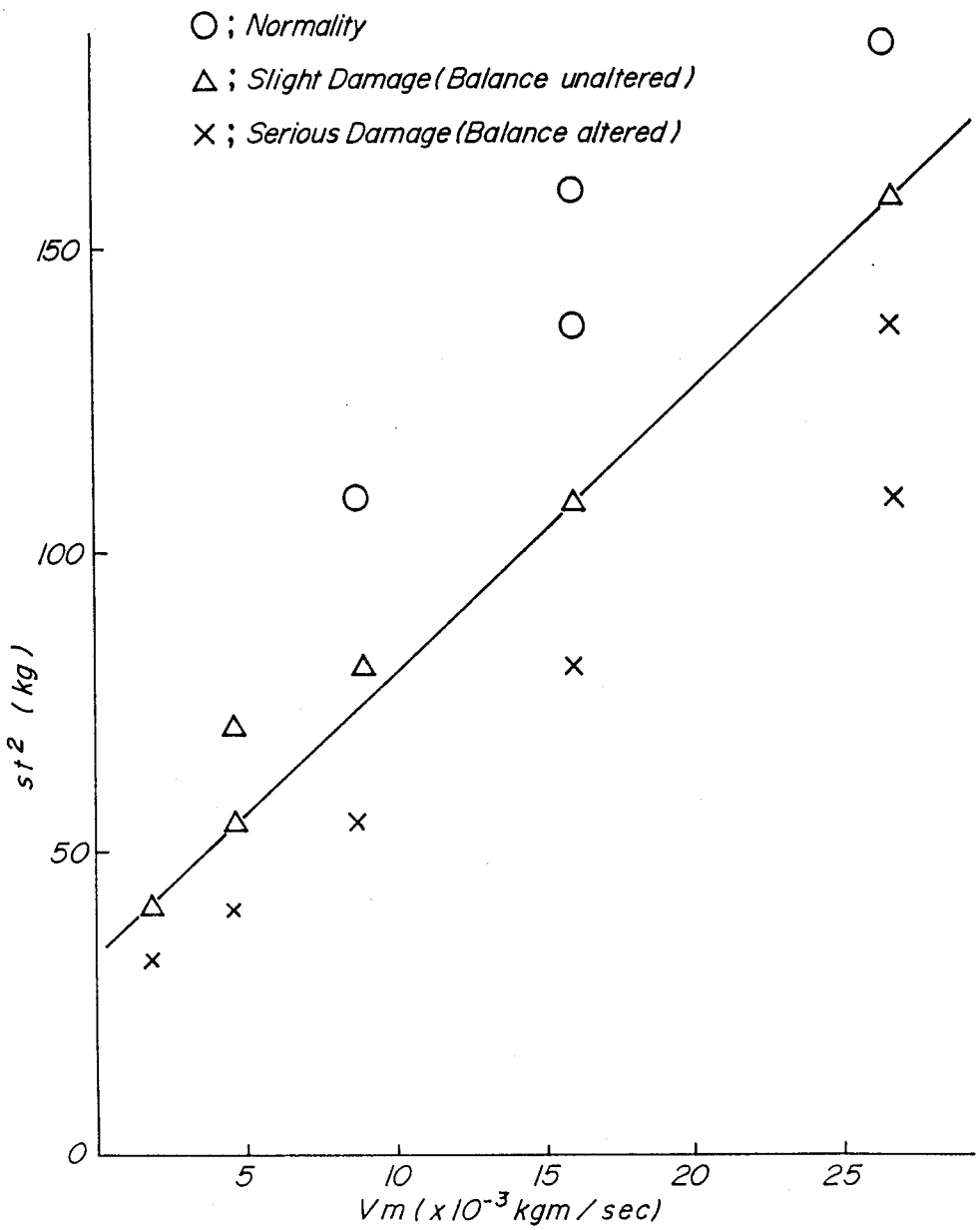
FIG. 6 is a graph illustrating a relation between the resistance $st^2$ against foreign objects and the product vm of the circumferential speed v of inducer tips of the rotor when blades are damaged by the mass of steel balls.

FIG. 6 is a graph illustrating relations between the resistant force $st^2$ against foreign objects and products vm of the circumferential speed v of inducer tip ends by the mass m of the steel ball on the basis of Table 1. It is clear from FIG. 6, when a relation $st^2 \geqq 5\times10^4 vm+33$ is fulfilled, there is no damage of turbine blade tips.

TABLE 1

| | No. | Strength of materials $s(\times 10^6\ kg/m^2)$ | Thickness of blade tips $t(\times 10^{-3}\ m)$ | Resistant force against foreign objects $st^2(kg)$ | Circumferential speed of turbines v(m/sec) | Mass of steel balls $m(\times 10^{-6}\ kg)$ | Momentum of foreign objects $vm(\times 10^{-4}\ kgm/sec)$ | Result: Vibration (G) | Result: Condition of blade tips |
|---|---|---|---|---|---|---|---|---|---|
| Embodiment of invention | 1 | 65 | 0.8 | 41.6 | 377 | 0.5 | 1.9 | 3 | Slight damage of blades |
| | 2 | 92 | 0.8 | 58.9 | 470 | 1.0 | 4.7 | 3 | Slight damage of blades |
| | 3 | 82 | 1.0 | 82.0 | 470 | 1.0 | 4.7 | 3 | No damage |
| | 4 | 82 | 1.0 | 82.0 | 470 | 2.0 | 9.4 | 3 | Slight damage of blades |

TABLE 1-continued

| | No. | Strength of materials s(× $10^6$ kg/m$^2$) | Thickness of blade tips t(× $10^{-3}$ m) | Resistant force against foreign objects st$^2$(kg) | Circumferential speed of turbines v(m/sec) | Mass of steel balls m(× $10^{-6}$ kg) | Momentum of foreign objects vm(× $10^{-4}$ kgm/sec) | Result: Vibration (G) | Result: Condition of blade tips |
|---|---|---|---|---|---|---|---|---|---|
| | 5 | 65 | 1.4 | 109.8 | 470 | 2.0 | 9.4 | 3 | No damage |
| | 6 | 65 | 1.4 | 109.8 | 534 | 3.0 | 16.0 | 3 | Slight damage of blades |
| | 7 | 92 | 1.2 | 132.5 | 534 | 3.0 | 16.0 | 3 | No damage |
| | 8 | 82 | 1.3 | 160.7 | 534 | 3.0 | 16.0 | 3 | No damage |
| | 9 | 82 | 1.3 | 160.7 | 534 | 5.0 | 26.7 | 3 | Slight damage of blades |
| | 10 | 92 | 1.4 | 180.3 | 534 | 5.0 | 26.7 | 3 | No damage |
| Comparison example | 1 | 50 | 0.8 | 32.5 | 377 | 0.5 | 1.9 | 8 | Serious damage of blades |
| | 2 | 50 | 0.9 | 40.5 | 470 | 1.0 | 4.7 | 6 | Serious damage of blades |
| | 3 | 65 | 0.9 | 52.6 | 470 | 2.0 | 9.4 | 8 | Serious damage of blades |
| | 4 | 82 | 1.0 | 82.0 | 534 | 3.0 | 16.0 | 11 | Serious damage of blades |
| | 5 | 65 | 1.3 | 109.8 | 534 | 5.0 | 26.7 | 11 | Serious damage of blades |
| | 6 | 92 | 1.2 | 132.5 | 574 | 5.0 | 28.7 | 7 | Serious damage of blades |

As can be seen from the above explanation, the ceramic radial turbine rotor according to the invention has turbine blade tips (inducers) having optimum thickness which are determined in design on the basis of used conditions of the rotor (circumferential speeds of the tips of the turbine blades or revolutions per minutes, and temperature), masses of foreign objects which may enter the turbine and strength of the ceramic material. Therefore, the ceramic radial turbine rotor according to the invention exhibits a large resistance to impingement of the foreign objects such as metal particles in operation of the turbine, thereby preventing damage of the blades.

While the invention has been particularly shown and described with reference to preferred embodiments thereof, it will be understood by those skilled in the art that the foregoing and other changes in form and details can be made therein without departing from the spirit and scope of the invention.

What is claimed is:

1. A ceramic radial turbine rotor, comprising:

a blade body having a plurality of blade tip portions which are highly resistant to breakage due to collisions with foreign objects, said blade body being made of a ceramic material having a strength s(kg/mm$^2$) and said blade tip portions having a thickness t (mm), wherein s and t are selected such that the following equation is fulfilled:

$$s \cdot t^2 \geqq (5 = 10^4)\ V \cdot m + 33$$

wherein V(m/sec) is a circumferential speed of an outermost radial portion of said blade tip portions when said radial turbine rotor is rotating, and m (kg) is the mass of a steel ball which collides against said body during a steel ball collision test used to evaluate said radial turbine rotor rotating at said circumferential speed V(m/sec).

2. A ceramic radial turbine rotor according to claim 1, wherein said ceramic material is selected from the group consisting of silicon nitride, silicon carbide and sialon.

* * * * *